United States Patent [19]

Michalik

[11] Patent Number: 4,496,338

[45] Date of Patent: Jan. 29, 1985

[54] FOLDING BLADE CYLINDER

[75] Inventor: Horst B. Michalik, Hochberg, Fed. Rep. of Germany

[73] Assignee: Koenig & Bauer Aktiengesellschaft, Fed. Rep. of Germany

[21] Appl. No.: 490,606

[22] Filed: May 2, 1983

[30] Foreign Application Priority Data

May 7, 1982 [DE] Fed. Rep. of Germany ..... 3217169

[51] Int. Cl.[3] ..... B21B 13/02

[52] U.S. Cl. ..... 493/367; 29/113 R; 493/426; 493/474

[58] Field of Search ..... 493/426–430, 493/432, , 367, 474; 29/113 R

[56] References Cited

U.S. PATENT DOCUMENTS

| | | | |
|---|---|---|---|
| 3,543,366 | 12/1970 | Collet | 493/374 |
| 3,991,994 | 11/1976 | Farish | 493/430 |
| 4,033,217 | 7/1977 | Flaum | 493/367 |
| 4,147,337 | 4/1979 | Bolza-Schünemann | 493/367 |
| 4,289,493 | 9/1981 | Hedrich | 493/426 |
| 4,327,467 | 5/1982 | Quaint | 29/113 R |
| 4,455,727 | 6/1984 | Tschirner | 29/113 R |

FOREIGN PATENT DOCUMENTS

| | | |
|---|---|---|
| 2011661 | 7/1971 | Fed. Rep. of Germany . |
| 136593 | 5/1978 | German Democratic Rep. . |

*Primary Examiner*—Leon Gilden

*Attorney, Agent, or Firm*—Jones, Tullar & Cooper

[57] ABSTRACT

A folding blade cylinder for use in a rotary printing machine is disclosed. The periphery of the cylinder is provided with a plurality of spaced circumferential slots. Arched carrying bows are positioned within the slots and elements which are capable of expanding under the influence of a pressurized fluid are placed in the slots underneath the carrying bows. Application of the pressurized fluid to the expandable elements forces the carrying bows radially outwardly to increase the peripheral size of the folding blade cylinder.

8 Claims, 2 Drawing Figures

FOLDING BLADE CYLINDER

FIELD OF THE INVENTION

The present invention is directed generally to a folding blade cylinder for use in a rotary printing machine. More particularly, the present invention is directed to a folding blade cylinder having an enlargeable periphery. Most specifically, the present invention is directed to a folding blade cylinder having a plurality of peripheral carrying bows supported by adjustable pneumatic or hydraulic means. The peripheral carrying bows, which are located in circumferential grooves in the peripheral surface of the folding blade cylinder, are supported by suitable pneumatically or hydraulically pressurized means whose pressurization is controllable. This allows the effective circumference of the folding cylinder to be adjusted. It also allows the paper web traction in the folding apparatus to be adjusted and maintained at a constant level. A control valve for the pressurizing means that supports the carrying bows allows the pressure to be reduced if the paper web exerts a pressure on the bows which is above a pre-selected value.

DESCRIPTION OF THE PRIOR ART

Folding blade cylinders for use in rotary printing machines are well known in the art both as to structure and function. Folding blade cylinders that are capable of having their periphery enlarged by means of a plurality of carrying bows are also known in the art, as may be seen in German Pat. No. 2011661. In this patent, the carrying bows are capable of being adjusted in height by being moved radially outwardly on the surface of the cylinder. These carrying bows are mechanically supported and adjusted so that once they have been placed in a desired expanded peripheral position, they do not include means for compensating for various strains exerted on them by the paper webs. Further, the prior folding cylinders having peripheries which are capable of being enlarged have tended to be somewhat complex in structure and have required considerable effort to operate.

SUMMARY OF THE INVENTION

It is an object of the present invention to provide a folding blade cylinder for use in a rotary printing machine.

Another object of the present invention is to provide a folding blade cylinder having a peripheral surface capable of being enlarged.

A further object of the present invention is to provide a folding blade cylinder whose periphery is enlargeable by pneumatic or hydraulic means.

Yet another object of the present invention is to provide a folding blade cylinder having means which permits adjustment of the paper web traction in the folding apparatus and maintenance of this traction as constant as possible.

Still a further object of the present invention is to provide a folding blade cylinder in which the strain exerted by the paper engaging pins on the paper web does not increase with increased paper web thickness.

As will be set forth in greater detail in the description of the preferred embodiment, the folding blade cylinder in accordance with the present invention includes a plurality of arched carrying bows disposed generally on the peripheral surface of the folding cylinder. Each of these carrying bows is placed in a longitudinal groove on the cylinder's surface and is resiliently held on the cylinder. A pressurizable means, such as a flexible tube, is placed between the inner surface of the carrying bow and the outer surface of the groove. Means for controlling the pressure in the tube or the like is provided so that each carrying bow can be forced radially outwardly to enlarge the periphery of the folding cylinder.

As was alluded to previously, the pressure or traction exerted on the paper web carried by the folding cylinder can be maintained constant even in the situation where paper web thickness is being varied. Such thickness variation would occur, for example, if the press were being used to print issues which were to be airmailed and hence of reduced weight. The maintenance of constant traction on the web is accomplished by controlling pressure in the pressurizable means such as the flexible tubes. The pressure being supplied to the pressure receiving means which are placed under the carrying bows, is readily controlled and adjusted by any suitable means and provides an apparatus which is not complex but yet is effective in maintaining a constant web traction. The folding blade cylinder in accordance with the present invention also allows the spring resilience constant to be altered within the range required.

BRIEF DESCRIPTION OF THE DRAWINGS

While the novel features of the folding blade cylinder in accordance with the present invention are set forth with particularity in the appended claims, a full and complete understanding of the invention may be had by referring to the detailed description of a preferred embodiment, as set forth hereinafter and as may be seen in the accompanying drawings in which:

DESCRIPTION OF THE PREFERRED EMBODIMENT

Figure 1:
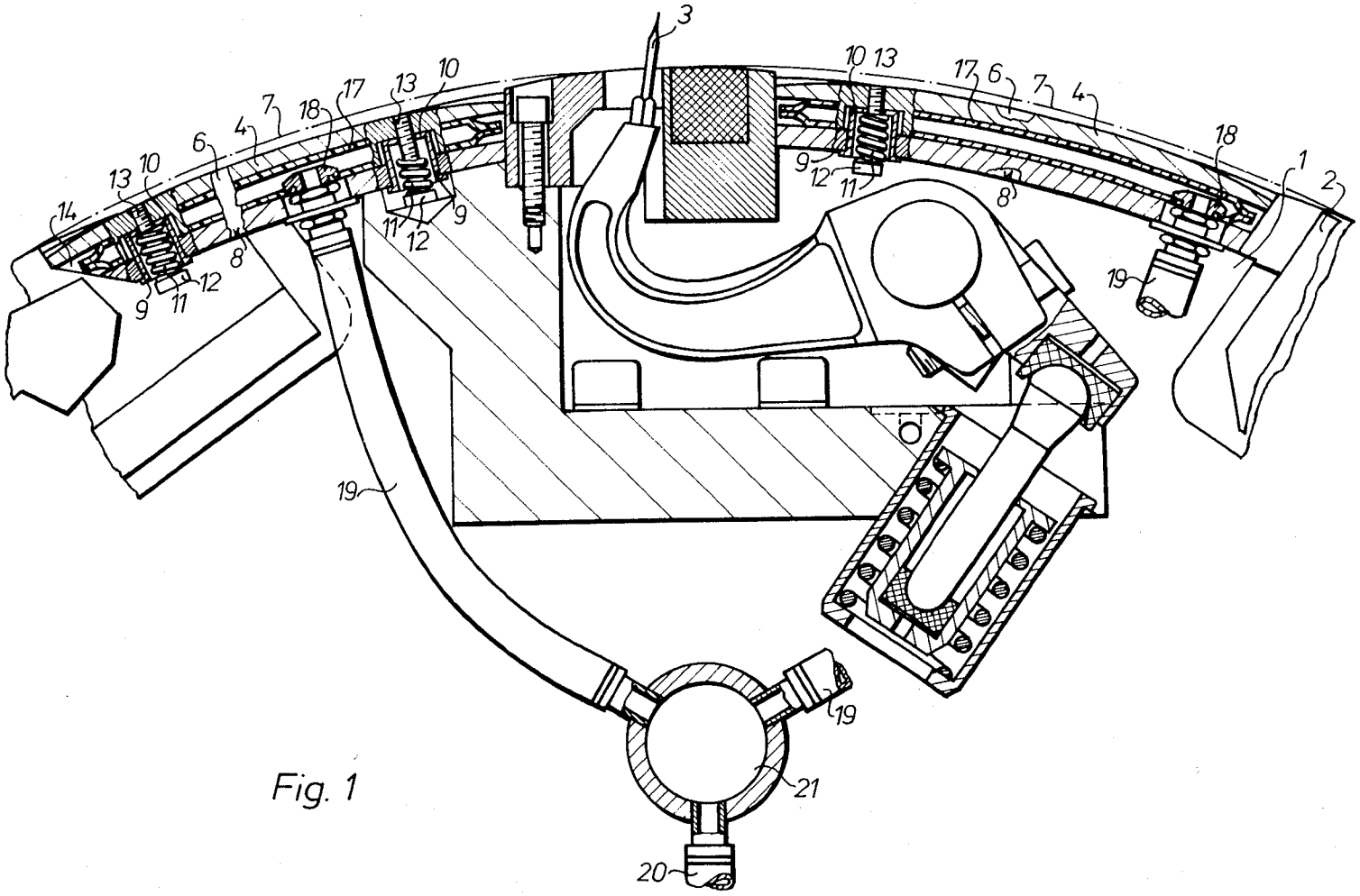
FIG. 1, is a vertical sectional view through a folding blade cylinder in accordance with the present invention and showing the mechanism of the invention.

Referring initially to FIG. 1, there may be seen a folding blade cylinder in accordance with the present invention generally at 1. Folding blade cylinder 1 includes spaced folding blades 2 and paper web gripping pins 3 which are generally conventional as to structure and operation. Since these blades 2 and pins 3, which receive the printed web and fold it in cooperation with a folder cylinder, are generally well known, no further description thereof is believed necessary, it being understood that the assembly in accordance with the present invention could be utilized equally well with various blade and pin assemblies.

Figure 2:
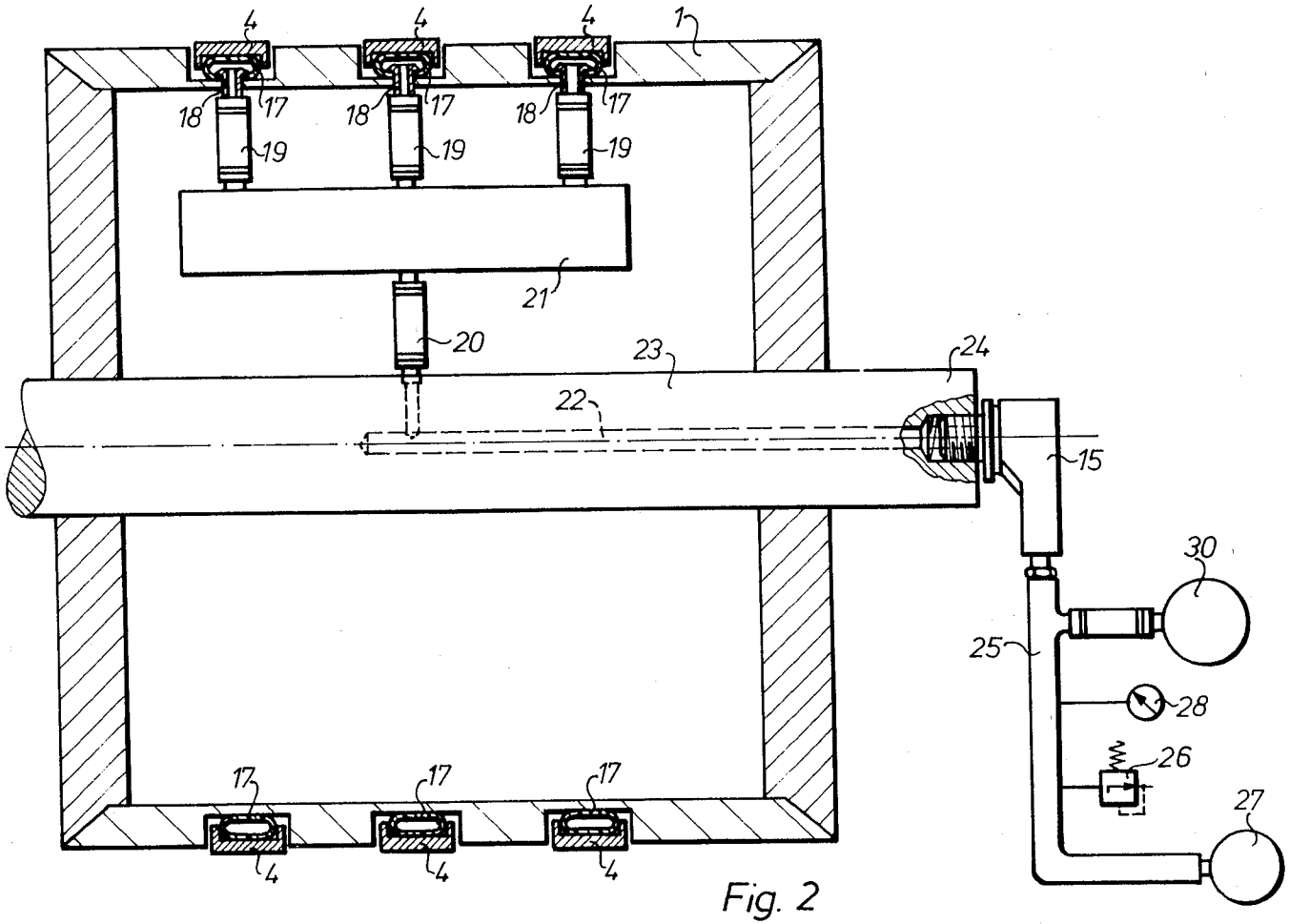
FIG. 2, is a cross-sectional schematic view of the folding blade cylinder in accordance with the present invention showing the pressurizing fluid feed means.

A plurality of arched or curved carrying bows 4 are disposed in a side by side orientation on a peripheral surface 7 of the folding blade cylinder 1, as may be seen in FIG. 1 and 2. Each of the carrying bows 4 is guided in a slot 6 formed on the surface of the cylinder. The slot 6 is sufficiently deep that the carrying bow 6 can be retracted under the periphery 7 of the folding plate cylinder. 1 A pair of open cylindrical bushings 9 are provided for each one of the carrying bows 4 with a first end of each bushing 9 being secured by welding or the like to a bottom surface 8 of the slot 6. These bushings 9 are, as may be seen in FIG. 1, spaced circumferentially from each other. Each bushing 9 carries a compression spring 11 with one end of spring 11 abutting a base 10 on the second end of each bushing 9 and with a second end of the spring 11 engaging a head portion 12 of an elongated screw 13 whose shank is encircled by compression spring 11. The screw 13 extends from the slot bottom 8 through the bushing base 10 and is screwed into the underside of the carrying bow 4. This screw and compression spring assembly thus serves to bias the carrying bow 4 toward the bottom 8 of the slot 6 and allows the carrying bow to move radially while preventing other motions.

A generally circular or annular flexible tube 17, which is closed at its extremities and is pressure tight, is positioned in a space 14 defined by the undersurface of the arched carrying bow 4 and the slot bottom 8. This flexible tube 17 may be fabricated from any suitable material such as, for example, PVC, and is structured to be between the two spaced bushings 9. A suitable connecting piece 18 or coupling is formed in each flexible tube 17 so that each tube can be joined to a source of pressurized fluid, such as a compressed air reservoir 21 by means of a flexible tube or pipe 19. This compressed air reservoir or the like 21 can either be located interiorly or exteriorly of the folding blade cylinder 1.

Turning now to FIG. 2, the compressed air reservoir 21, which is shown positioned within the folding blade cylinder, is joined by a flexible tube or pipe 20 to a blind bore 22 that extends along the center of a shaft 23 which supports, and rotates with the folding blade cylinder 1. One end 24 of shaft 23 is provided with a rotary connection 15 that is in fluid communication with the hollow bore 22 in the center of shaft 23. A source of compressed air 27 is connected to the hollow bore 22 through rotary connection 15 by a pipe 25. A pressure control valve 26 and a manometer or pressure gauge 28 are placed in the line 25 between the compressed air source 27 and the rotary connection 15. An external compressed air reservoir 30 may also be placed in the line.

In operation, if the flexible tubes are not under pressure supplied by the compressed air source 27, they are compressed by the compression springs 11 carried between the carrying bows 4. However, as pressurized fluid is fed to the tubes 17, they become pressurized and force the carrying bows 4 radially outwardly to encrease the effective circumference of the folding blade cylinder 1. The pressure applied to the flexible tubes 17 can be adjusted within very small tolerances by the pressure control valve 26.

A paper web, which has been printed in the rotary printing machine with which the present folding blade cylinder operates, is pinned-up on the pins 3 until it is cut by a suitable cutting blade in a known manner. If the pressure exerted by the paper web by reason of the last driven pair of feed rolls and the folding blade cylinder 1 exceeds the pressure or traction adjusted for by means of the pressure control valve 26, the flexible tubes 17 will be compressed. Thus the air pressure in tubes 17 and hence in the rest of the system; i.e., flexible pipes 19, reservoir 21, flexible pipe 20, bore 22, pipe 25, and reservoir 30 will similarly be increased. If this pressure exceeds the pre-selected pressure, the pressure control valve 26 will blow off to bring the pressure back to the desired level. The carrying bows 4 can then move radially inwardly so that the traction or force exerted on the paper web between pins 3 and the last pair of feed rolls is reduced.

While a full and complete description of a preferred embodient of a folding blade cylinder in accordance with the present invention has been fully and completely set forth hereinabove, it will be obvious to one of skill in the art that a number of changes could be made. For example, other biasing means such as diaphragm cylinders or air pistons could be substituted for the flexible tubes 17. Furthermore, other pressure means such as hydraulic fluid could be substituted for compressed air. Such changes would not affect the spirit or scope of the subject invention which accordingly, should be limited only by the following claims.

I claim:

1. A folding blade cylinder for use in a rotary printing machine, said folding blade cylinder comprising:

a plurality of slots spaced side by side in the direction of the longitudinal axis of said cylinder and extending circumferentially around a portion of the periphery of said cylinder;

a plurality of radially adjustable carrying bows disposed in said slots and biased radially inwardly in said slots;

expandable means positioned within said slots radially inwardly of said carrying bows; and means for pressurizing said expandable means to force said carrying bows radially outwardly against said inward bias.

2. The folding blade cylinder of claim 1, wherein each of said expandable means is a flexible tube and further wherein said means for pressurizing said expandable means is a source of compressed air.

3. The folding blade cylinder of claim 2, wherein a compressed air reservoir is provided within said cylinder and is in fluid communication with said flexible tubes and said source of compressed air.

4. The folding blade cylinder of claim 2, wherein an external compressed air reservoir is in fluid communication with said flexible tubes and said source of compressed air.

5. The folding blade cylinder of claim 2, wherein a blind bore is provided in a support shaft of said cylinder, said compressed air source supplying compressed air to said flexible tubes through a rotary connection in fluid communication with said bore, said flexible tubes being joined to said bore.

6. The folding blade cylinder of claim 2, wherein a pressure control valve is interposed between said flexible tubes and said source of compressed air.

7. The folding blade cylinder of claim 1, wherein each of said expandable means is a diaphragm cylinder.

8. The folding blade cylinder of claim 1, wherein each of said expandable means is an air piston.

* * * * *